US005466658A

United States Patent [19]

Harrison et al.

[11] Patent Number: 5,466,658

[45] Date of Patent: Nov. 14, 1995

[54] THERMAL DYE TRANSFER RECEIVING ELEMENT FOR MORDANTING IONIC DYES

[75] Inventors: Daniel J. Harrison; William H. Simpson, both of Pittsford; Wayne A. Bowman, Walworth; Kristine B. Lawrence, Rochester; Helmut Weber, Webster, all of N.Y.

[73] Assignee: Eastman Kodak Company, Rochester, N.Y.

[21] Appl. No.: 358,123

[22] Filed: Dec. 16, 1994

[51] Int. Cl.[6] ..... B41M 5/035; B41M 5/038

[52] U.S. Cl. ..... 503/227; 428/195; 428/500; 428/913; 428/914

[58] Field of Search ..... 8/471; 428/195, 428/500, 913, 914; 503/227

[56] References Cited

U.S. PATENT DOCUMENTS 4,987,049 1/1991 Komamura et al. ..... 430/203

FOREIGN PATENT DOCUMENTS 506034 9/1992 European Pat. Off. .
535608 4/1993 European Pat. Off. .

*Primary Examiner*—B. Hamilton Hess
*Attorney, Agent, or Firm*—Harold E. Cole

[57] ABSTRACT

A dye-receiving element for receiving a thermally-transferred ionic dye comprising a support having thereon a dye image-receiving layer, wherein the dye image-receiving layer comprises an elastomeric binder with a Tg of less than 25° C. and a polymeric mordant for the ionic dye dispersed in the binder.

20 Claims, No Drawings

THERMAL DYE TRANSFER RECEIVING ELEMENT FOR MORDANTING IONIC DYES

This invention relates to dye-receiving elements used in thermal dye transfer, and more particularly to the use of a polymeric binder and mordant for retaining ionic dyes.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to one of the cyan, magenta or yellow signals, and the process is then repeated for the other two colors. A color hard copy is thus obtained which corresponds to the original picture viewed on a screen. Further details of this process and an apparatus for carrying it out are contained in U.S. Pat. No. 4,621,271, the disclosure of which is hereby incorporated by reference.

Dye receiving elements used in thermal dye transfer generally include a support (transparent or reflective) having on one side thereof a dye image-receiving layer. The dye image-receiving layer conventionally comprises a polymeric material chosen from a wide assortment of compositions for its compatibility and receptivity for the dyes to be transferred from the dye donor element. For example, there may be used polyurethanes, polyesters, polycarbonates, addition polymers, etc., with or without lamination of a cover layer for improved image stability.

Retransfer is a potential image stability problem with thermal dye transfer images. The receiver must act as a medium for dye diffusion at elevated temperatures, yet the transferred image dye must not be allowed to migrate from the final print. Retransfer is observed when another surface comes into contact with a final print. Such surfaces may include paper, plastics, binders, backside of (stacked) prints, and some album materials.

Another problem is that images created by thermal dye transfer techniques have a propensity to degrade when stored in poly(vinyl chloride) (PVC) folders or sleeves. Wherever direct contact is established between the image and PVC, plasticizers present in the PVC act on the imaged dyes. These plasticizers solubilize the image dye thereby allowing the dye to diffuse out from the receiver medium into the PVC folders or sleeves. When a thermal dye transfer image is removed from a PVC cover, distinct areas are observed where the image dye has migrated into the PVC. While polymeric overcoats may provide adequate protection against dye fade, they offer minimal protection against retransfer of the dyes to PVC cover sheets.

European Patent Applications 535,608 and 506,034 describe the mordanting of anionic dyes in thermal dye transfer receiver elements containing cationic mordants dispersed in thermoplastic polymer binders. U.S. Pat. No. 4,987,049 describes the use of thermoplastic binders with a Tg in the range of 40° to 250° C. for a metal-containing dye mordanting receiver. There is a problem with the above polymeric binders, however, in that the image dyes are not always retained or fixed in the receiver polymer to the desired extent. As will be shown below, it has been found that the selection of the receiver binder can greatly impact the extent to which the image dye is fixed in the receiver.

It is an object of this invention to provide a dye-receiver element for thermal dye transfer which has improved resistance to retransfer, especially to PVC covers. It is another object of this invention to provide a dye-receiver element for fixing ionic dyes which are thermally transferred to it.

These and other objects are achieved in accordance with this invention which comprises a dye-receiving element for receiving a thermally-transferred ionic dye comprising a support having thereon a dye image-receiving layer, wherein the dye image-receiving layer comprises an elastomeric binder with a Tg of less than 25° C. and a polymeric mordant for the ionic dye dispersed in the binder.

Polymers as known as being "thermoplastic" if their softening temperature lies above room temperature. Polymers with a softening temperature below room temperature are defined as elastomers. In amorphous polymers, the softening temperature is best characterized as the glass transition temperature (Tg). The molecular diffusivity of an image dye is greatly restricted in a glassy polymer.

In a dye transfer imaging system, the dye-donor and dye-receiver elements are heated above their Tg's so that the image dye can rapidly diffuse out of the dye-donor layer and into the dye-receiver. This heating process typically requires from 5 to 30 ms. However, in a dye mordanting system, this time may be too short to allow the dye to completely react with the mordant. If the receiver layer comprises a thermoplastic binder, the reaction of the image dye with the mordant would be limited by the printing time. After printing, the receiver binder would become glassy, thus restricting diffusion of unreacted image dye to available mordant sites.

In accordance with this invention, an elastomeric binder is used which allows the diffusion of image dye to available mordant sites after printing, since molecular diffusion of the image dye will not be restricted.

Any elastomeric binder can be used in the invention provided it has a Tg of less than 25° C. For example, there can be used polybutadiene, polyisoprene, polyethylene, polyurethanes, polycarbonates, polyesters, etc. In a preferred embodiment, acrylic polymers or copolymers are used such as polybutyl acrylate, polyethylhexyl acrylate, polyethylpropyl acrylate, etc.

The elastomeric binder in the dye image-receiving layer may be present in any amount which is effective for its intended purpose. In general, good results have been obtained at a binder concentration of from about 0.5 to about 10 $g/m^2$.

Any polymeric mordant can be used in the invention provided it will be effective in mordanting ionic dyes. For example, there can be used anionic or cationic polymers or copolymers.

Suitable anionic mordants include any polymer containing anionic groups such as sulfonic acid, carboxylic acid, salicylic acid, phosphonic acid, phosphoric acid, etc. In a preferred embodiment, the anionic mordant comprises acrylic acid.

Suitable cationic mordants include any polymer containing cationic groups such as quaternary ammonium groups, tertiary ammonium groups or substituted phosphonium groups. In a preferred embodiment, the cationic mordant is a copolymer comprising a tetraalkyl or alkylaryl ammonium group.

The polymeric mordant in the dye image-receiving layer may be present in any amount which is effective for its intended purpose. In general, good results have been obtained at a mordant concentration of from about 0.5 to about 10 g/m$^2$.

The support for the dye-receiving element of the invention may be transparent or reflective, and may comprise a polymeric, a synthetic paper, or a cellulosic paper support, or laminates thereof. Examples of transparent supports include films of poly(ether sulfone)s, poly(ethylene naphthalate), polyimides, cellulose esters such as cellulose acetate, poly(vinyl alcohol-co-acetal)s, and poly(ethylene terephthalate). The support may be employed at any desired thickness, usually from about 10 μm to 1000 μm. Additional polymeric layers may be present between the support and the dye image-receiving layer. For example, there may be employed a polyolefin such as polyethylene or polypropylene. White pigments such as titanium dioxide, zinc oxide, etc., may be added to the polymeric layer to provide reflectivity. In addition, a subbing layer may be used over this polymeric layer in order to improve adhesion to the dye image-receiving layer. Such subbing layers are disclosed in U.S. Pat. Nos. 4,748,150, 4,965,238, 4,965,239, and 4,965241, the disclosures of which are incorporated by reference. The receiver element may also include a backing layer such as those disclosed in U.S. Pat. Nos. 5,011,814 and 5,096,875, the disclosures of which are incorporated by reference.

Resistance to sticking during thermal printing may be enhanced by the addition of release agents to the dye receiving layer or to an overcoat layer, such as silicone based compounds, as is conventional in the art.

Dye-donor elements that are used with the dye-receiving element of the invention conventionally comprise a support having thereon a dye-containing layer. Any dye can be used in the dye-donor employed in the invention provided it is an ionic dye and is transferable to the dye-receiving layer by the action of heat. Such dyes are generally acidic or basic ionizable dye compounds. These dyes are typically transferred in their ionized state. However, they may also be weakly buffered with suitable counter-ions which will not interfere with the mordanting process. Examples of such dyes are described in European Patent Applications 535,608, 506,034 and 580,120, the disclosures of which are incorporated by reference.

As noted above, dye-donor elements are used to form a dye transfer image. Such a process comprises imagewise-heating a dye-donor element and transferring a dye image to a dye-receiving element as described above to form the dye transfer image.

In a preferred embodiment of the invention, a dye-donor element is employed which comprises a poly(ethylene terephthalate) support coated with sequential repeating areas of an ionic cyan, magenta and yellow dye, and the dye transfer steps are sequentially performed for each color to obtain a three-color dye transfer image. Of course, when the process is only performed for a single color, then a monochrome dye transfer image is obtained.

Thermal printing heads which can be used to transfer dye from dye-donor elements to the receiving elements of the invention are available commercially. There can be employed, for example, a Fujitsu Thermal Head (FTP-040 MCS001), a TDK Thermal Head F415 HH7-1089 or a Rohm Thermal Head KE 2008-F3. Alternatively, other known sources of energy for thermal dye transfer may be used, such as lasers as described in, for example, GB No. 2,083,726A.

A thermal dye transfer assemblage of the invention comprises (a) a dye-donor element as described above, and (b) a dye-receiving element as described above, the dye-receiving element being in a superposed relationship with the dye-donor element so that the dye layer of the donor element is in contact with the dye image-receiving layer of the receiving element.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner. After thermal dye transfer, the dye image-receiving layer contains a thermally-transferred dye image.

The following examples are provided to further illustrate the invention.

EXAMPLE 1

Synthesis of Poly(ethyl acrylate-co-styrene-co-2-(N,N,N-trimethylammonium) ethyl methacrylate methosulfate) (75:20:5), Polymer B4

To a 3-liter addition flask were added 1.2 liter degassed, distilled water, 18 mL 75% Ethoquad® 0/12 (a quaternary ammonium surfactant from Akzo Chemie America), 4.5 g 2,2'-azobis(2-methylpropionamidine) dihydrochloride, 675 g ethyl acrylate, 180 g styrene, and 113 g 80% 2-(N,N,N-trimethylammonium) ethyl methacrylate methosulfate. The contents of the flask were stirred under nitrogen. To a 5-liter reaction flask were added 2.4 liter degassed, distilled water and 18 ml 75% Ethoquad® 0/12. The reaction flask was stirred under nitrogen and heated to 80° C. under nitrogen for 2 hours to give a translucent latex. The contents were cooled to 25° C. and the pH was adjusted to 6.0 with 10% sodium hydroxide. The latex contained 21% solids.

EXAMPLE 2

Synthesis of Poly(N-(3-aminopropyl)-2-methyl-2-propenamide monohydrochloride-co-acrylic acid butyl ester) (5:95), Polymer B6

This polymer was prepared in a similar manner to B4 above, except using N-(3-aminopropyl)-2-methyl-2-propenamide monohydrochloride and acrylic acid butyl ester.

EXAMPLE 3

Synthesis of Poly(acrylic acid 2-ethylhexyl ester-co-N-(3-aminopropyl)-2-methyl-2-propenamide monohydrochloride) (95:5), Polymer B7

This polymer was prepared in a similar manner to B4 above, except using acrylic acid 2-ethylhexyl ester and N-(3-aminopropyl)-2-methyl-2-propenamide monohydrochloride.

EXAMPLE 4

Synthesis of Mordant M1

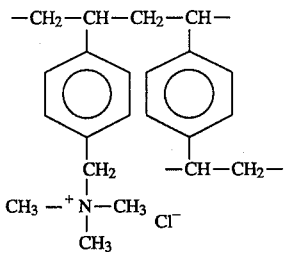

This cationic mordant was prepared according to the procedure outlined in U.S. Pat. No. 3,958,995 (col. 12. lines 30–70).

EXAMPLE 5

Synthesis of Mordant M2

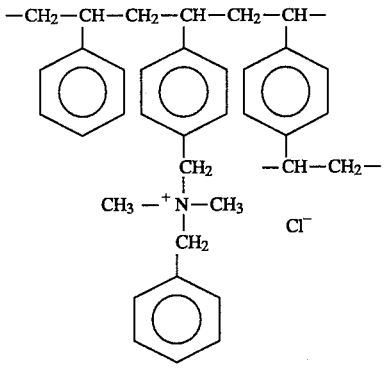

To a 5-liter reaction flask were added 1.6 liter degassed, distilled water and 10 ml Ethoquad® 0/12 and the flask heated to 80° C. To a 2-liter addition flask were added 1 liter degassed, distilled water, 10 ml Ethoquad® 0/12, 206 g styrene, 301 g chloromethyl-styrene, 9.6 g divinylbenzene, and 8 g 2,2'-azobis(2-methylpropionamidine) dihydrochloride. The mixture was stirred under nitrogen. Then 2.2 g 2,2'-azobis(2-methylpropionamidine) dihydrochloride was added to the reaction flask over a period of 50 minutes. The contents of the flask were stirred under nitrogen at 80° C. for 3 hours and then cooled to 50° C. and diluted with 600 ml distilled water to give a white suspension. 256 g of dimethylbenzylamine was added with stirring over a period of 30 minutes and the mixture was stirred at 50° C. for 16 hours to give a viscous suspension. The suspension was cooled and filtered to remove a small amount of coagulum. The suspension contained 20% solids.

EXAMPLE 6

The following materials were used in preparing dye-donor elements:

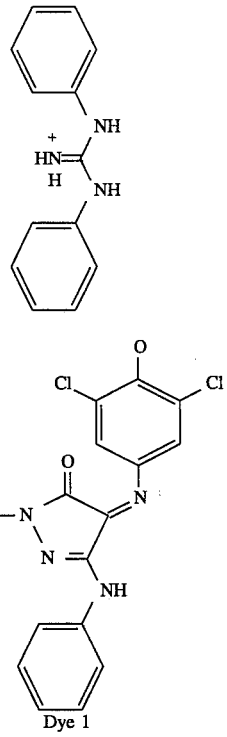

Dye 1

(This is similar to I-4 in EPA 535,608)

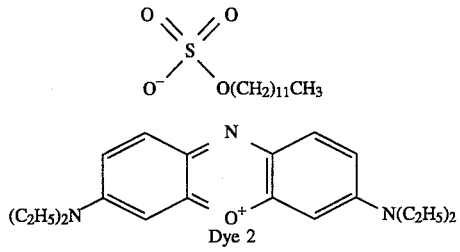

Dye 2

(This is similar to dye 3a on page 4 in EPA 580,120)

Anionic Dye-Donor Element:

A coating solution of Dye 1 (0.43 g/m$^2$), Butvar 76® poly(vinyl alcohol-co-butyral) (Monsanto Co.), (0.65 g/m$^2$), Fluorad FC-431® nonionic surfactant (3M Corp.) (0.011 g/m$^2$) in methyl ethyl ketone was hand-coated at 27 ml/m$^2$ onto a poly(ethylene terephthalate) support and dried at 43° C. A slipping layer of Emralon 329® (polytetrafluoroethylene particles in a thermoplastic resin (Acheson Colloids Co.) was applied to the side of the support opposite from the dye side.

Cationic Dye-Donor Element:

Dye 2 (0.25 g/m$^2$) and KL3-1013 Makrolon® polyether-modified bisphenol A polycarbonate resin (Bayer AG) (0.25 g/m$^2$) were dissolved in a dichloromethane/trichloroethylene 80:20 wt. % solvent mixture. Fluorad FC-431® (0.11 g/m$^2$) surfactant was added and the solution coated at 27 ml/m$^2$. The resulting dye donor layer coated onto a poly(ethylene terephthalate) support similar to that for the anionic dye-donor element.

Dye-Receiver Formulations:

Dye-receiver elements according to the invention were prepared (invention 1-invention 7) based on two cationic mordants (M1 and M2) and one anionic mordant (M3). Control dye-receiver elements (Control 1-Control 5) were also prepared containing non-elastomeric binders.

Cationic Mordants M1 and M2:

All receiver formulations were prepared by dissolving the binder polymer and adding Triton X-100® surfactant (Rohm & Hass Co.). To this solution was slowly added the predissolved mordant polymer, with stirring to prevent agglomeration and coagulation. All variations were coated on a gelatin-subbed reflective paper support. The water-based coatings were dried at 60° C.; the solvent-based coatings were dried at 25° to 32° C. Table 1 shows the dry coating coverage for the various binders and mordants used in addition to the coating solvents.

Anionic Mordant M3:

The designated binder was dissolved in the solvent, surfactant added, followed by the addition of 2.8 g of a 1M solution of tetrabutylammonium hydroxide in methanol per gram of poly(acrylic acid). The mordant (poly(acrylic acid)) had been predissolved in methanol; acetone was added, and the resulting solution mixed slowly with that of the binder.

The resulting formulations were coated and dried onto a microvoided support which had been subbed with 107 mg/m$^2$ Dow Z6020 (N-2-aminoethyl)-3-aminopropyl-trimethoxysilane (Dow Chemical Co.) coated from ethanol. The support consisted of a cellulose paper core with a polyethylene layer (30.2 g/m$^2$) on the back side and a microvoided packaging film (Mobil OPP 350TW) extrusion-laminated to the front side of the paper core with 12.2 g/m$^2$ of polypropylene. The microvoided structure is described in U.S. Pat. No. 5,244,861.

The ratios of dry coating coverages for binder and mordant are given in Table 1 for all receiver formulations.

TABLE 1

| Receiver | Mordant | Binder | Binder/ Mordant | Solvent |
|---|---|---|---|---|
| Control 1 | M1 | B1 | 1.1/2.2 | Methyl alcohol/acetone (80/20) |
| Control 2 | M1 | B2 | 0.43/0.81 | Methyl alcohol/acetone (60/40) |
| Control 3 | M1 | B3 | 0.81/1.9 | Methyl alcohol/acetone (60/40) |
| Invention 1 | M1 | B4 | 1.1/2.2 | Water |
| Invention 2 | M1 | B5 | 1.1/2.2 | Methyl alcohol/acetone (70/30) |
| Invention 3 | M1 | B6 | 1.1/2.2 | Water |
| Invention 4 | M1 | B7 | 1.1/2.2 | Water |
| Control 4 | M2 | B8 | 1.1/2.2 | Water |
| Invention 5 | M2 | B4 | 1.6/3.2 | Water |
| Invention 6 | M2 | B7 | 1.1/2.2 | Water |
| Control 5 | M3 | B9 | 2.50/0.92 | Methyl alcohol/acetone (65/25) |
| Invention 7 | M3 | B5 | 2.50/0.92 | Methyl alcohol/acetone (65/25) |

Legend:
The binder/mordant ratios shown are those derived from the dry laydowns in g/m$^2$ for the two components.
B1 Butvar 98 ® poly(vinyl butyral) (Monsanto Chemical Co.)
B2 poly(vinyl chloride-co-vinyl acetate-co-vinyl alcohol) #064 (Scientific Polymer Products Co.)
B3 polyurethane (Eastman Kodak Co.)
B4 poly(ethyl acrylate-co-styrene-co-2-(N,N,N-trimethylammonium) ethyl methacrylate methosulfate) (75:20:5) (Eastman Kodak Co.)
B5 poly(n-butyl acrylate) (Eastman Kodak Co.)
B6 poly(N-(3-aminopropyl)-2-methyl-2-propenamide monohydrochloride-co-acrylic acid butyl ester) (5:95) (Eastman Kodak Co.)
B7 poly(acrylic acid 2-ethylhexyl ester-co-N-(3-aminopropyl)-2-methyl-2-propenamide monohydrochloride) (95:5) (Eastman Kodak Co.)
B8 polyvinylpyrrolidone (Eastman Kodak Co.)

TABLE 1-continued

| Receiver | Mordant | Binder | Binder/ Mordant | Solvent |
|---|---|---|---|---|

B9 blend of poly(ethyl methacrylate) and poly(n-butyl acrylate) (75:25) (Eastman Kodak Co.)

Test Procedures:

Imaged prints were prepared by placing the dye-donor element in contact with the polymeric dye-receiving layer side of the receiver element. The assemblage was fastened to the top of the motor driven 53 mm diameter rubber roller. A TDK thermal head, F415 HH-71089, thermostated at 30° C. was pressed with a force of 36 N against the dye-donor element side of the assemblage pushing it against the rubber roller. The TDK F415 HH-71089 thermal print head has 512 independently addressable heaters with a resolution of 5.4 dots/mm, an active printing width of 95 mm and an average heater resistance of 512 ohms. The imaging electronics were activated and the assemblage was drawn between the print head and roller at 20.6 mm/s. Coincidentally, the resistive elements in the thermal print head were pulsed on for 128 μs. Printing maximum density requires 127 pulses "on" time per printed line of 17 ms. When the voltage supplied was 12 volts, a maximum total energy required to print a 1.5–2.2 Dmax density was 4.78 mJ/dot. A monochrome image consisting of five step wedges was obtained. Each wedge contained nine steps of different density. After printing, the dye-donor and dye-receiver elements were peeled apart.

Following printing, each of the imaged receiver samples was covered with a sheet of plasticized PVC. The imaged, PVC-covered samples were then stacked and placed into a polyethylene-lined foil envelope and submitted for incubation of 7 days duration at 50° C. and 50% relative humidity. The envelope containing the samples was left unsealed to allow for humidity equilibration between the stacked samples and the incubation chamber. A one kilogram (70–75 kg/m$^2$) weight was placed on top of the stacked receiver at the start of the incubation and removed only at the conclusion when the samples were removed from the incubation chamber.

Following incubation, the PVC sheet was removed from each of the imaged receivers. The Status A green transmission density measurements on the PVC at the 1.0 density step were taken before and after incubation using an X-Rite densitometer (X-Rite Inc., Grandville, Mich.) to determine the quantity of dye which had diffused into the PVC. The following results were obtained:

TABLE 2

| Receiver | Binder Tg (°C.) | Retransfer Density |
|---|---|---|
| Control 1 | 82 | 0.12 |
| Control 2 | 79 | 0.14 |
| Control 3 | 40 | 0.16 |
| Invention 1 | 5 | 0.03 |
| Invention 2 | −49 | 0.07 |
| Invention 3 | −50 | 0.03 |
| Invention 4 | −65 | 0.01 |
| Control 4 | 170 | 0.17 |
| Invention 5 | 5 | 0.01 |
| Invention 6 | −65 | 0.01 |
| Control 5* | 40 | 0.33 |
| Invention 7 | −49 | 0.24 |

*anionic mordant in receiver, cationic dye donor D-2

The above results show that significant improvements in dye fixation are observed in thermal dye transfer involving dye mordanting in the dye-receiving layer. This is true with mordanting of an anionic dye in a dye-receiving layer comprising a polymeric cationic mordant (Invention 1–4, 5 and 6) dispersed in an elastomeric, i.e., low-Tg binder, as well as mordanting a cationic dye in a dye-receiving layer comprising a polymeric anionic mordant (Invention 7) dispersed in an elastomeric binder.

The invention has been described in detail with particular reference to preferred embodiments thereof, but it will be understood that variations and modifications can be effected within the spirit and scope of the invention.

What is claimed is:

1. A dye-receiving element for receiving a thermally-transferred ionic dye comprising a support having thereon a dye image-receiving layer, wherein said dye image-receiving layer comprises an elastomeric binder with a Tg of less than 25° C. and a polymeric mordant for said ionic dye dispersed in said binder.

2. The element of claim 1 wherein said polymeric mordant is a polymer or copolymer containing anionic groups.

3. The element of claim 2 wherein said polymer or copolymer comprises acrylic acid.

4. The element of claim 1 wherein said polymeric mordant is a polymer or copolymer containing cationic groups.

5. The element of claim 4 wherein said polymer or copolymer comprises a tetraalkyl or alkylaryl ammonium group.

6. The element of claim 4 wherein said polymeric mordant is cross-linked.

7. The element of claim 1 wherein said elastomeric binder comprises an acrylic polymer or copolymer.

8. A process of forming a dye transfer image comprising imagewise-heating a dye-donor element comprising a support having thereon a dye layer comprising an ionic dye dispersed in a polymeric binder and transferring a dye image to a dye-receiving element to form said dye transfer image, said dye-receiving element comprising a support having thereon a dye image-receiving layer, wherein said dye image-receiving layer comprises an elastomeric binder with a Tg of less than 25° C. and a polymeric mordant for said ionic dye dispersed in said binder.

9. The process of claim 8 wherein said polymeric mordant is a polymer or copolymer containing anionic groups.

10. The process of claim 9 wherein said polymer or copolymer comprises acrylic acid.

11. The process of claim 8 wherein said polymeric mordant is a polymer or copolymer containing cationic groups.

12. The process of claim 11 wherein said polymer or copolymer comprises a tetraalkyl or alkylaryl ammonium group.

13. The process of claim 11 wherein said polymeric mordant is cross-linked.

14. The process of claim 8 wherein said elastomeric binder comprises an acrylic polymer or copolymer.

15. A thermal dye transfer assemblage comprising:

(a) a dye-donor element comprising a support having thereon a dye layer comprising an ionic dye dispersed in a polymeric binder, and (b) a dye-receiving element comprising a support having thereon a dye image-receiving layer, said dye-receiving element being in a superposed relationship with said dye-donor element so that said dye layer is in contact with said dye image-receiving layer; wherein said dye image-receiving layer comprises an elastomeric binder with a Tg of less than 25° C. and a polymeric mordant for said ionic dye dispersed in said binder.

16. The assemblage of claim 15 wherein said polymeric mordant is a polymer or copolymer containing anionic groups.

17. The assemblage of claim 16 wherein said polymer or copolymer comprises acrylic acid.

18. The assemblage of claim 15 wherein said polymeric mordant is a polymer or copolymer containing cationic groups.

19. The assemblage of claim 18 wherein said polymer or copolymer comprises a tetraalkyl or alkylaryl ammonium group.

20. The assemblage of claim 15 wherein said elastomeric binder comprises an acrylic polymer or copolymer.

* * * * *